US010242775B2

(12) United States Patent
Huang et al.

(10) Patent No.: US 10,242,775 B2
(45) Date of Patent: Mar. 26, 2019

(54) VARIABLE RESISTOR WITH LIGHT EMITTING ELEMENT

(71) Applicant: TAIWAN ALPHA ELECTRONIC CO., LTD., Taoyuan (TW)

(72) Inventors: Tzu-Hsuan Huang, Taoyuan (TW); Wei-Liang Liu, Taoyuan (TW); Chien-Chih Ho, Taoyuan (TW)

(73) Assignee: TAIWAN ALPHA ELECTRONIC CO., LTD., Taoyuan (TW)

( * ) Notice: Subject to any disclaimer, the term of this patent is extended or adjusted under 35 U.S.C. 154(b) by 259 days.

(21) Appl. No.: 15/400,027

(22) Filed: Jan. 6, 2017

(65) Prior Publication Data

US 2017/0256342 A1 Sep. 7, 2017

(30) Foreign Application Priority Data

Mar. 3, 2016 (TW) ..... 105106457 A

(51) Int. Cl.
*H01C 10/38* (2006.01)
*H01C 10/44* (2006.01)

(52) U.S. Cl.
CPC ..... *H01C 10/38* (2013.01); *H01C 10/44* (2013.01)

(58) Field of Classification Search
CPC ..... H01C 10/38; H01C 10/44
USPC ..... 338/119
See application file for complete search history.

(56) References Cited

U.S. PATENT DOCUMENTS 4,792,780 A * 12/1988 Takahashi ..... H01C 10/38 338/176
9,443,647 B2 * 9/2016 Huang ..... H01C 10/44

* cited by examiner

*Primary Examiner* — Kyung S Lee
*Assistant Examiner* — Iman Malakooti
(74) *Attorney, Agent, or Firm* — Muncy, Geissler, Olds & Lowe, P.C.

(57) ABSTRACT

A variable resistor with a light emitting element includes a circuit board, a housing and a slide assembly. The circuit board extending in a longitudinal direction has a circuit arrangement surface to arrange thereon a resistive circuit and a power circuit. The housing fixed to the circuit board so as to form a slide space has a sliding slot extending in the longitudinal direction. The slide assembly further includes a slidable member, a fader set, a light emitting element, a resistive circuit brush and two light-emitting element brushes. The fader set fixed at the slidable member penetrates the sliding slot. The light emitting element in an accommodating groove of the slidable member projects a light beam toward the fader set. The resistive circuit brush electrically connects the resistive circuit. The two light-emitting element brushes electrically bridge the power circuit and the light emitting element.

13 Claims, 8 Drawing Sheets

VARIABLE RESISTOR WITH LIGHT EMITTING ELEMENT

This application claims the benefit of Taiwan Patent Application Serial No. 105106457, filed Mar. 3, 2016, the subject matter of which is incorporated herein by reference.

BACKGROUND OF INVENTION

1. Field of the Invention

The invention relates to a variable resistor, and more particularly to the variable resistor with a light emitting element.

2. Description of the Prior Art

Generally speaking, a conventional variable resistor is manually manipulated to purposely output a division voltage. In ordinary life, the variable resistor is normally seen in a tone-tuning device. Since the tone-tuning device is usually used in dark surroundings, such as studios, nightclubs, and the like, thus a task to precisely manipulate the variable resistor so as to output a demanded division voltage for controlling the tone-tuning device is comparably difficult in such an adverse environment.

In addition, among ordinary household appliances, audio equipment usually applies variable resistors to perform necessary modulations. In particular, the ambient lights are usually adjusted to a lower brightness level for achieving specific amusement purposes, but, under this situation, accurate modulations in time upon the corresponding variable resistors would be more infeasible. Thus, the original amusement purpose might be hurt.

As explained above, in the art, accurate modulating the variable resistor so as to timely produce a desired voltage output for controlling the device is difficult in dark surroundings. Thus, an improvement upon the variable resistor for providing a reliable modulating means to overcome the aforesaid shortcoming in the conventional design is definitely necessary.

SUMMARY OF THE INVENTION

In view that the conventional variable resistor cannot be modulated relevantly and timely in dark surroundings, thus the maneuverability therein of the variable resistor is severely affected. Accordingly, it is the primary object of the present invention to provide a variable resistor with a light emitting element, by which a user can adjust the variable resistor in time and accurately in dark surroundings so as to output precisely a desired division voltage.

In the present invention, the variable resistor with a light emitting element includes a circuit board, a housing and a slide assembly. The circuit board extending in a longitudinal direction has a circuit arrangement surface to arrange thereon a resistive circuit and a power circuit. The housing is fixed to the circuit board so as to form therebetween an internal slide space extending in the longitudinal direction, and further has a sliding slot extending in the longitudinal direction and being communicative in space with the slide space.

The slide assembly includes a slidable member, a fader set, a light emitting element, a resistive circuit brush and two light-emitting element brushes. The slidable member movable in the longitudinal direction in the slide space has a light-emitting element mounting surface and a brush mounting surface to face the sliding slot and the circuit board, respectively. The slidable member further includes a light-emitting element accommodating groove located at the light-emitting element mounting surface by closing to the sliding slot. The fader set is fixed at the slidable member, and penetrates the sliding slot. The light emitting element disposed in the light-emitting element accommodating groove is to project a light beam toward the fader set. The resistive circuit brush disposed on the brush mounting surface is electrically connected with the resistive circuit. The two light-emitting element brushes disposed on the brush mounting surface are to electrically bridge the power circuit and the light emitting element. When the slidable member displaces in the longitudinal direction, the light emitting element continuously emits the light beam.

In one embodiment of the present invention, the slidable member further includes two terminal cavities located separately at the brush mounting surface The two terminal cavities are communicative individually in space with the light-emitting element accommodating groove. Two electrodes of the light emitting element are electrically connected individually with the corresponding two light-emitting element brushes via passing through the corresponding terminal cavities. Preferably, the two electrodes are plugged into the two terminal cavities, and each of the two light-emitting element brushes has a spring structure plugged in the corresponding terminal cavity and electrically connected with the corresponding electrode. In addition, the spring structure has an interference structure to contact at the corresponding electrode.

In one embodiment of the present invention, the two light-emitting element brushes are riveted individually onto the slidable member.

In one embodiment of the present invention, the slide assembly further includes two lateral sliding rack located fixedly and in parallel in the slide space. Each of the two lateral sliding racks has a sliding groove extending in the longitudinal direction. Two lateral sides of the slidable member are to slide along the corresponding sliding grooves of the respective lateral sliding racks, such that the slidable member is able to displace in the longitudinal direction in the slide space. Preferably, the slide assembly further includes two end blocks disposed separately in the slide space to couple opposing ends of the two lateral sliding racks. Each of the two end blocks is engaged the two lateral sliding racks at one side thereof and contacts the housing and the circuit board at other sides so as to locate fixedly the two lateral sliding racks in the slide space.

In one embodiment of the present invention, the slide assembly further includes two sliding bars located fixedly and in parallel in the slide space and extending in the longitudinal direction. The two sliding bars penetrate the slidable member so as to allow the slidable member to displace in the longitudinal direction in the slide space. Preferably, the slide assembly further includes two end blocks disposed in the slide space at opposing ends of the two sliding bars. Each of the two end blocks contacts the two sliding bars, the housing and the circuit board so as to locate the two sliding bars fixedly in the slide space.

In one embodiment of the present invention, the fader set includes a protrusive fader stem and a fader cap. The protrusive fader stem is located fixedly at the slidable member by protruding through the sliding slot. The fader cap is capped to the protrusive fader stem. The light beam of the light emitting element is projected onto the protrusive fader stem. Preferably, the fader cap is transparent.

In one embodiment of the present invention, the fader set includes two protrusive fader stems fixed at the slidable member by standing oppositely to two opposing sides of the light-emitting element accommodating groove and forming a slit in between. The two protrusive fader stems protrude to penetrate the sliding slot, and the light beam emitted by the light emitting element is projected through the slit. Preferably, the fader cap is transparent.

By compared with the conventional variable resistors that can't be operated well in time in dark surroundings, the variable resistor with a light emitting element of the present invention introduces a light emitting element to the slidable member. The light emitting element projects the light beam toward the fader set. Thereupon, the user of the variable resistor can locate the fader set clearly in time via the light beam projected by the light emitting element.

All these objects are achieved by the variable resistor with a light emitting element described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a variable resistor with a light emitting element. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
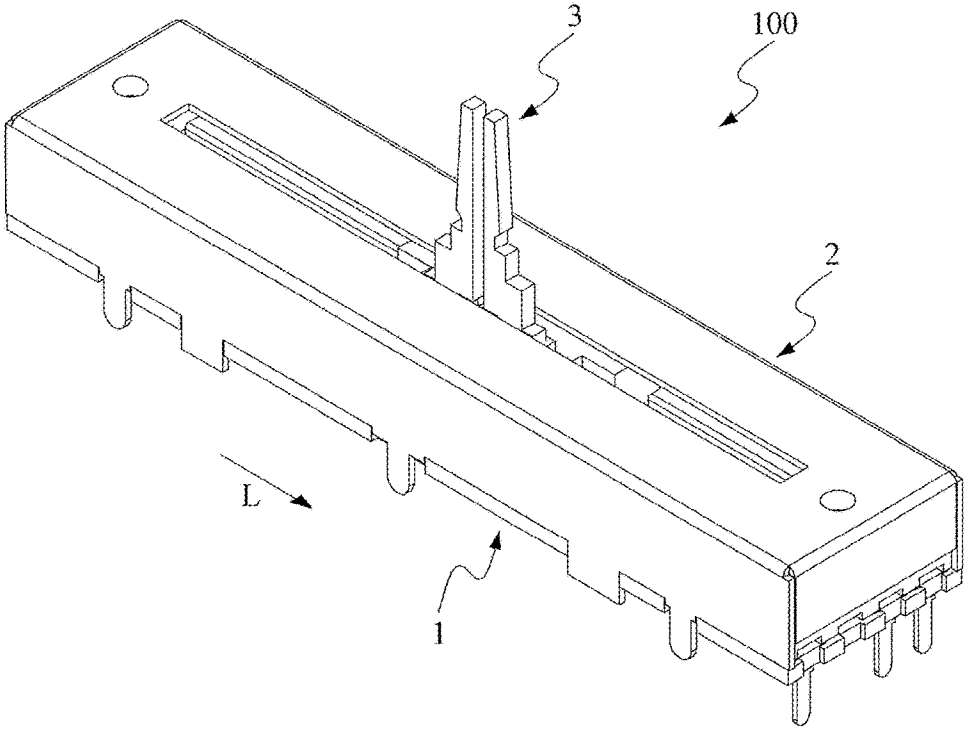
FIG. 1 is a schematic perspective view of a preferred embodiment of the variable resistor with a light emitting element in accordance with the present invention.
Figure 2:
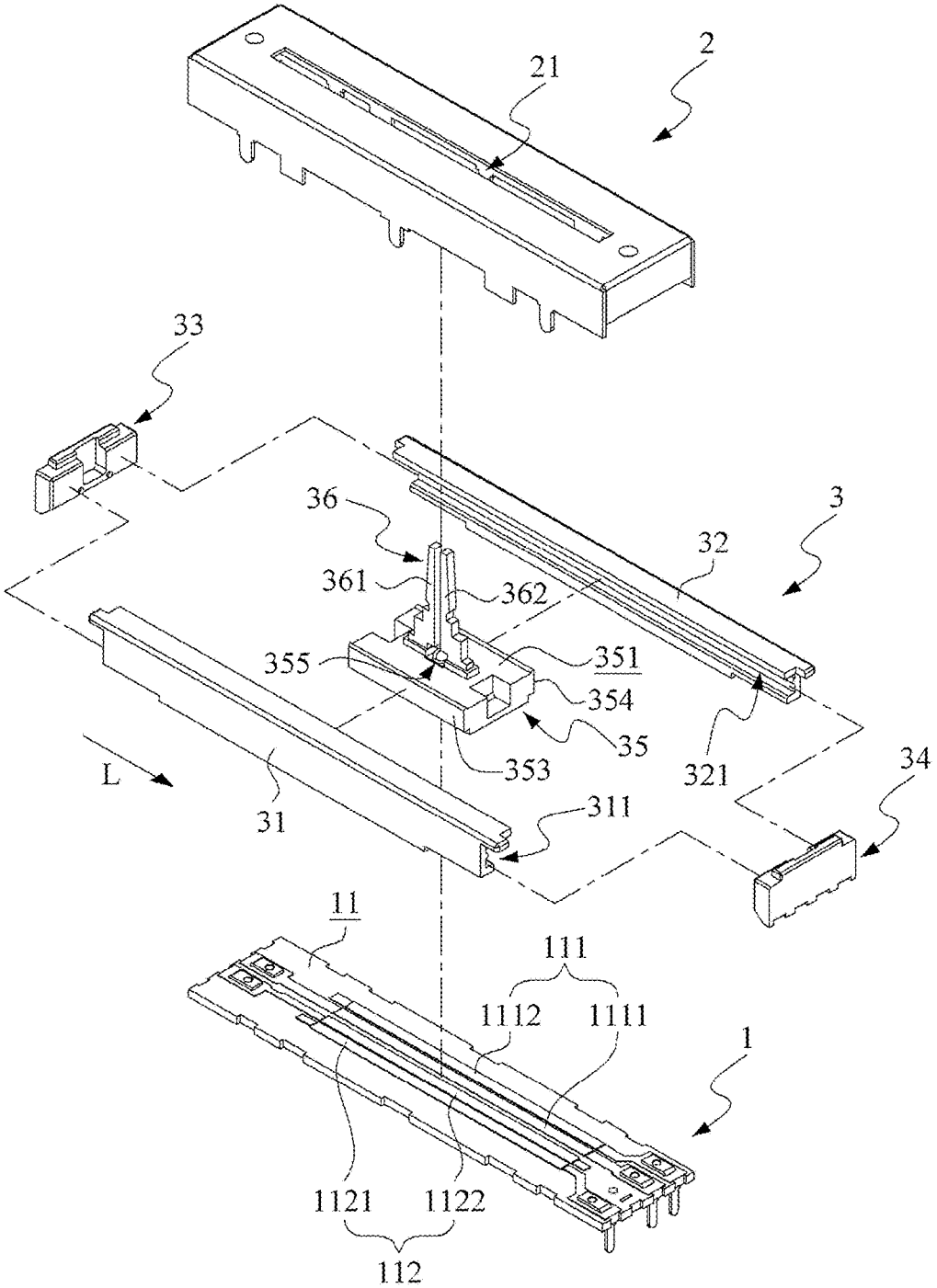
FIG. 2 is a largely schematic exploded view of FIG. 1.
Figure 3:
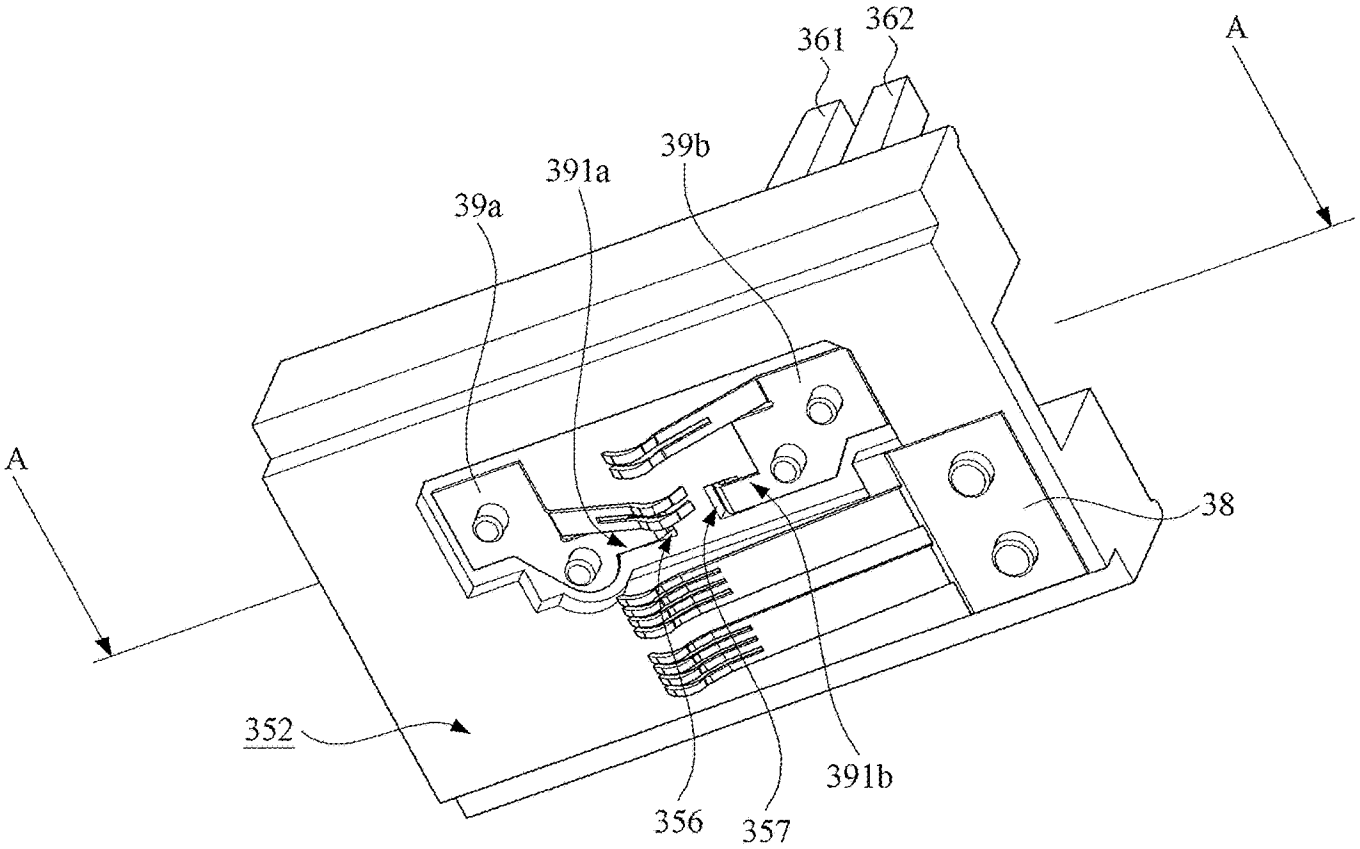
FIG. 3 is another schematic perspective view of the slidable member, the fader set, the resistive circuit brush and the light-emitting element brush of FIG. 1.
Figure 4:
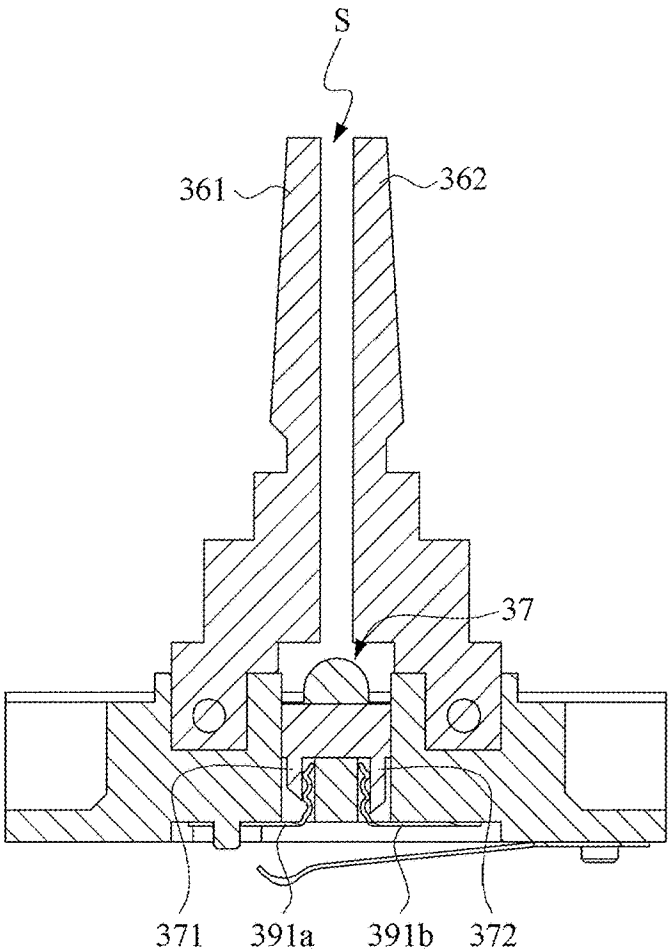
FIG. 4 is a schematic cross-sectional view of FIG. 3 along line A-A.
Figure 5:
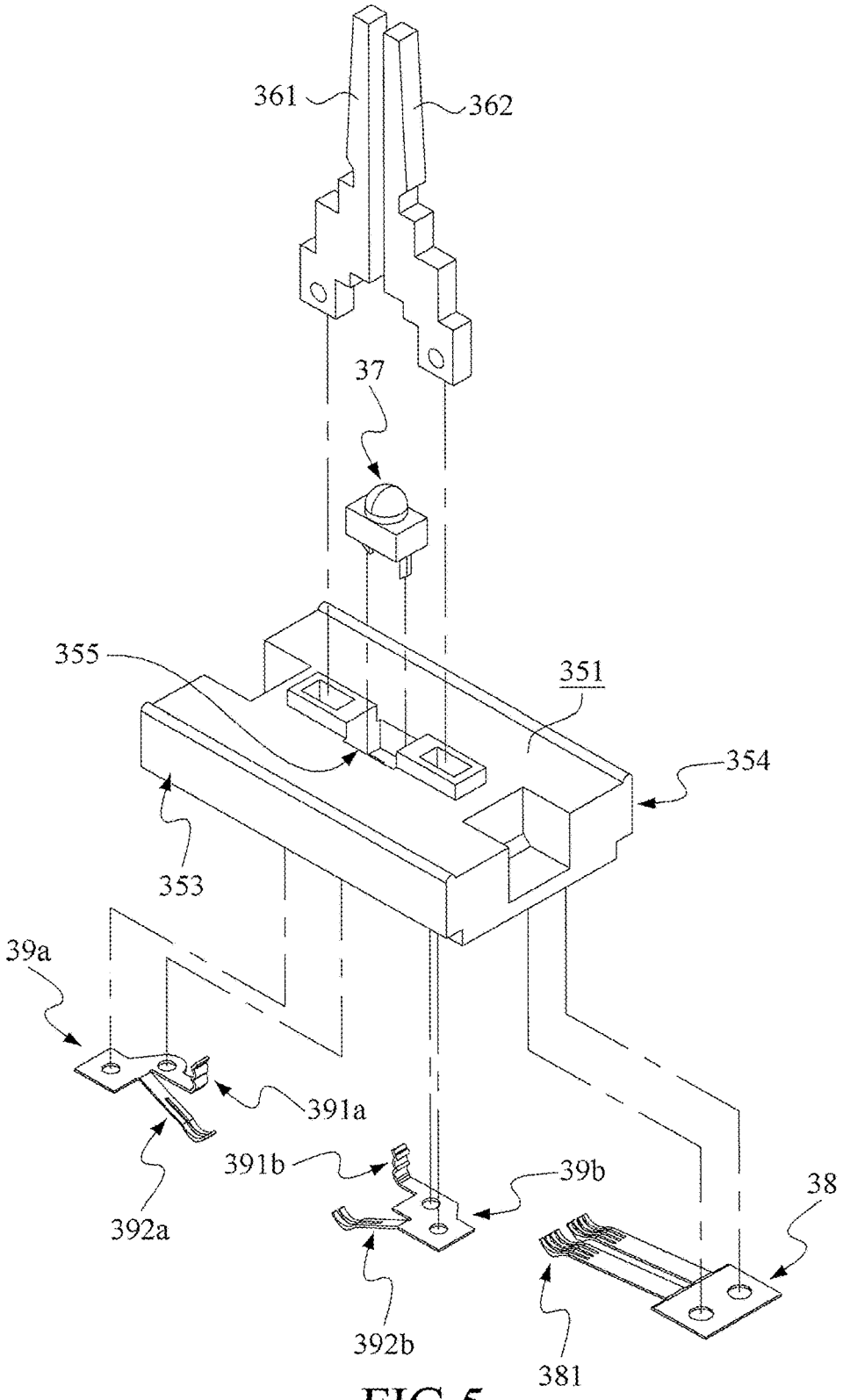
FIG. 5 is a schematic exploded view of the slidable member, the light emitting element, the fader set, the resistive circuit brush and the light-emitting element brush of FIG. 1.

Refer now to FIG. 1 through FIG. 5; where FIG. 1 is a schematic perspective view of a preferred embodiment of the variable resistor with a light emitting element in accordance with the present invention, FIG. 2 is a largely schematic exploded view of FIG. 1, FIG. 3 is another schematic perspective view of the slidable member, the fader set, the resistive circuit brush and the light-emitting element brush of FIG. 1, FIG. 4 is a schematic cross-sectional view of FIG. 3 along line A-A, and FIG. 5 is a schematic exploded view of the slidable member, the light emitting element, the fader set, the resistive circuit brush and the light-emitting element brush of FIG. 1.

As shown, the variable resistor 100 with a light emitting element includes a circuit board 1, a housing 2 and a slide assembly 3. The circuit board 1 extending in a longitudinal direction L has a circuit arrangement surface 11. A resistive circuit 111 and a power circuit 112 are arranged on the circuit arrangement surface 11. The resistive circuit 111 includes a resistive layer 1111 and a conductive layer 1112, in which the resistive layer 1111 is constantly connected with a power source and the conductive layer 1112 is used to output a voltage signal. The power circuit 112 includes a first electrode layer 1121 and a second electrode layer 1122. In this embodiment, the resistive layer 1111, the conductive layer 1112, the first electrode layer 1121 and the second electrode layer 1122 are all extended in the longitudinal direction L in a separate and parallel manner. The resistive layer 1111 is neighbored to the conductive layer 1112, while the first electrode layer 1121 is neighbored to the second electrode layer 1122.

The housing 2 is fixed to the circuit board 1 so as to form therebetween an internal slide space (not shown in the figure) extending in the longitudinal direction L. The housing 2 further includes a sliding slot 21 extending in the longitudinal direction L and communicative in space with the slide space. In practice, the housing 2 can be a metallic casing buckled fixedly to the circuit board 1 via a plurality of protrusions (not shown in the figure) at the bottom rim of the casing. The engaging means between the circuit board 1 and the housing 2 can be various but all well known in the art, and thus details thereabout are omitted herein.

The slide assembly 3 includes two lateral sliding racks 31 and 32, two end blocks 33 and 34, a slidable member 35, a fader set 36, a light emitting element 37, a resistive circuit brush 38 and two light-emitting element brushes **39*a* and 39*b***.

The lateral sliding rack 31 at the left hand side of FIG. 2 has a sliding groove 311 extending in the longitudinal direction L, while the lateral sliding rack 32 at the right hand side of FIG. 2 has another sliding groove 321 also extending in the longitudinal direction L.

The two end blocks 33 and 34 are disposed in the slide space to couple adjacent ends of the two lateral sliding racks 31 and 32 at opposing end sides of the two lateral sliding racks 31 and 32. Each of the two end blocks 33 and 34 are engaged the two lateral sliding racks 31 and 32 at one side and contacted with the housing 2 and the circuit board 1 at other sides so as to locate fixedly the two lateral sliding racks 31 and 32 in the slide space.

The slidable member 35 has a light-emitting element mounting surface 351, a brush mounting surface 352 and two lateral sides 353 and 354. The light-emitting element mounting surface 351 is facing the sliding slot 21, the brush mounting surface 352 opposing to the light-emitting element mounting surface 351 is facing the circuit board 1, and the two lateral sides 353 and 354 connect the light-emitting element mounting surface 351 and the brush mounting surface 352 at opposing sides of the slidable member 35. The two lateral sides 353 and 354 are to slide along the corresponding sliding grooves 311 and 321 of the lateral sliding racks 31 and 32, respectively. Thereupon, the slidable member 35 can be movable back and forth in the longitudinal direction L in the slide space.

In addition, the slidable member 35 further includes a light-emitting element accommodating groove 355 and two terminal cavities 356 and 357. The light-emitting element accommodating groove 355 is located at the light-emitting element mounting surface 351 by closing to the sliding slot 21. The two terminal cavities 356 and 357 are located separately at the brush mounting surface 352 and communicatively individually in space with the light-emitting element accommodating groove 355.

The fader set 36 includes two separate protrusive fader stems 361 and 362 fixed at the slidable member 31 by standing oppositely to two opposing sides of the light-emitting element accommodating groove 355 and forming a slit S in between. The two protrusive fader stems 361 and 362 are to penetrate the sliding slot 21. In practice, the slidable member 31 cab be formed to anchor the two protrusive fader stems 361 and 362 by injection molding.

The light emitting element 37 disposed in the light-emitting element accommodating groove 355 is to project a light beam into the slit S of the fader set 36. The light emitting element 37 has two electrodes 371 and 372 plugged into the two terminal cavities 356 and 357, respectively.

The resistive circuit brush 38 disposed on the brush mounting surface 352 has two claw poles 381 (only one labeled in the figure). The two claw poles 381 are electrically connected with the resistive layer 1111 and the conductive layer 1112 of the resistive circuit 111, respectively. In this embodiment, the resistive circuit brush 38 is riveted onto the brush mounting surface 352. In practice, the brush mounting surface 352 may have two nodes (not shown in the figure), and the resistive circuit brush 38 may have two corresponding holes (not shown in the figure). By having the two nodes to penetrate the two holes of the resistive circuit brush 38, and further by applying a riveting means upon the nodes, then the resistive circuit brush 38 can be fixed firmly to the slidable member 35 in a rivet manner.

The light-emitting element brush 39*a* disposed on the brush mounting surface 352 has a spring structure 391*a* and a claw pole 392*a*. The spring structure 391*a* is plugged into the terminal cavity 356, while the claw pole 392*a* is elastically contacted at the electrode 371 in an electric connection manner. Similarly, the light-emitting element brush 39*b* disposed on the brush mounting surface 352 has a spring structure 391*b* and a claw pole 392*b*. The spring structure 391*b* is plugged into the terminal cavity 357, while the claw pole 392*b* is elastically contacted at the electrode 372 in an electric connection manner. In this embodiment, the spring structures 391*a* and 391*b* are prolonged bent structures protruded from the main body of the light-emitting element brush 39*a* and extended into the corresponding terminal cavities 356 and 357 for electrically coupling the corresponding electrodes 371 and 372 of the light emitting element 37. Further, since the light-emitting element brushes 39*a* and 39*b* are electrically contacted at the first electrode layer 1121 and the second electrode layer 1122 of the power circuit 112, respectively, the electric connection between the power circuit 112 and the light emitting element 37 is thus established. Thereupon, as the slidable member 35 displaces in the longitudinal direction L, the light emitting element 37 is constantly energized to emit a light beam projecting through the slit S.

As described above, by comparing to the conventional variable resistor that can work well in dark surroundings, the variable resistor with a light emitting element in accordance with the present invention introduces a light emitting element to the slidable member, and the light emitting element is electrically coupled with the power circuit through the light-emitting element brush. Hence, no matter where the slidable member is displaced to any position, the light beam provide by the light emitting element and projecting through the fader set can always show the exact position of the fader set to the user, even in extreme dark surroundings.

Figure 6:
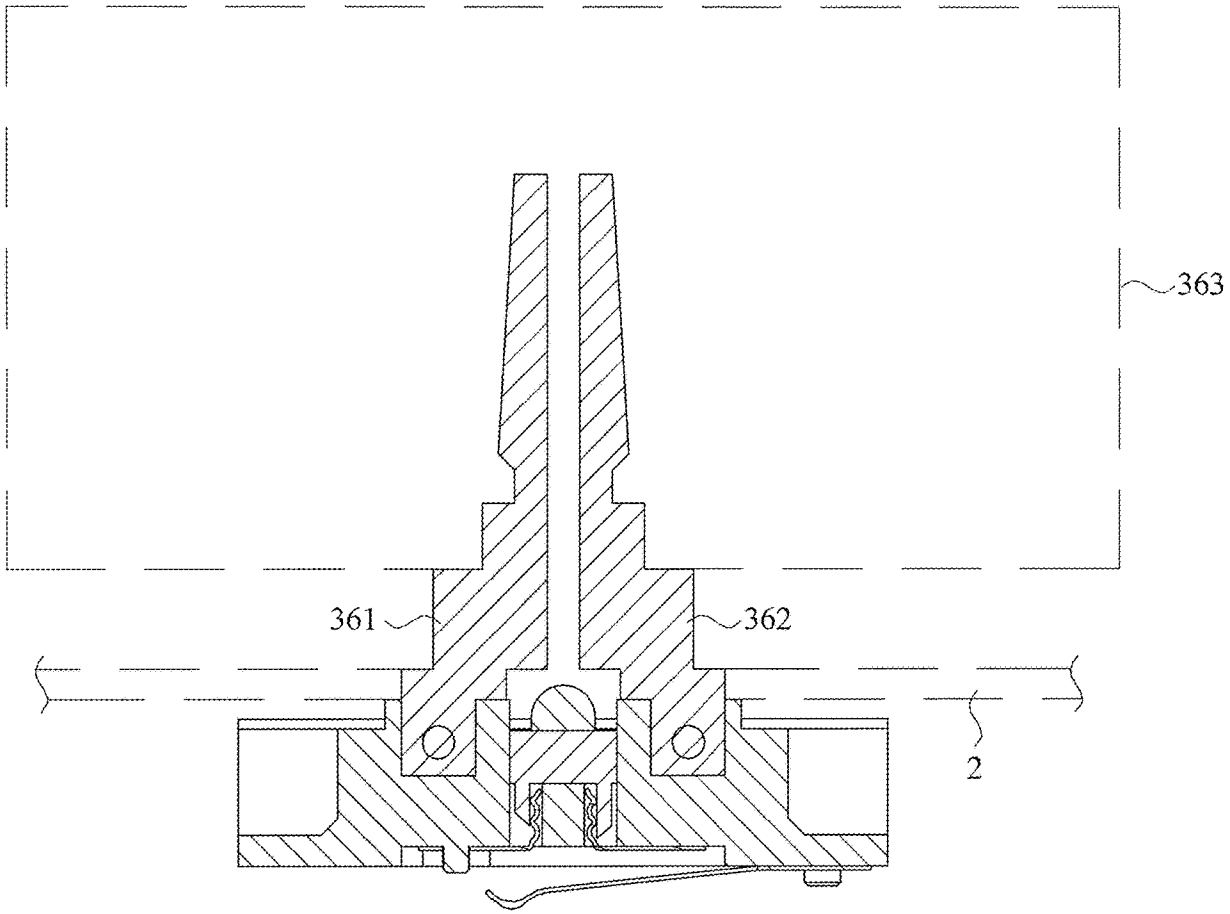
FIG. 6 shows schematically an application of FIG. 4.

Referring now to FIG. 6, an application of the variable resistor of FIG. 4 is schematically demonstrated. As shown, the fader set 36 is capped with an fader cap 363 (symbolized by dashed lines). In practice, the fader cap 363 is fixedly engaged with the two protrusive fader stems 361 and 362. Preferably, the fader cap 363 is transparent. Thus, when the light emitting element 37 emits the light beam to project through the slit S and onto the fader cap 363, the fader cap 363 would scatter the light beam, so that the user would be clearly aware of the exact position of the fader cap 363.

Figure 7:
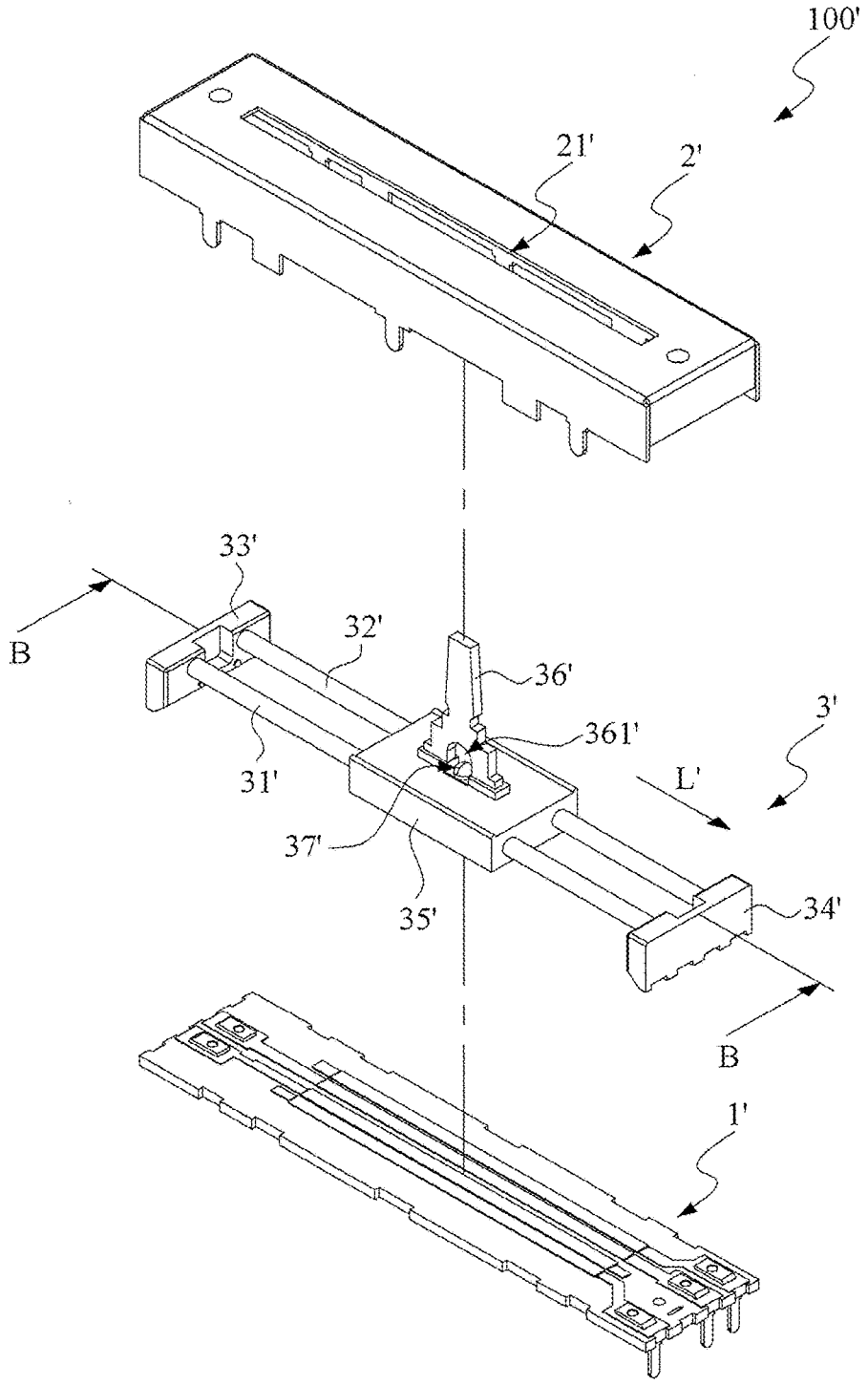
FIG. 7 is a largely schematic exploded view of another embodiment of the variable resistor with a light emitting element in accordance with the present invention.
Figure 8:
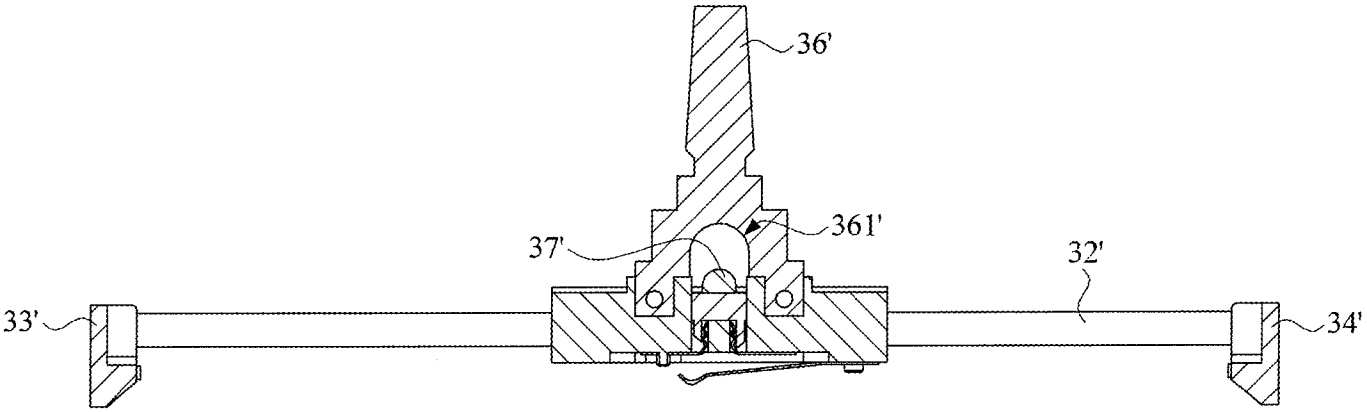
FIG. 8 is a schematic cross-sectional view of FIG. 7 along line B-B.

Refer now to FIG. 7 and FIG. 8; where FIG. 7 is a largely schematic exploded view of another embodiment of the variable resistor with a light emitting element in accordance with the present invention, and FIG. 8 is a schematic cross-sectional view of FIG. 7 along line B-B. As shown, the variable resistor with a light emitting element 100' includes a circuit board 1', a housing 2' and a slide assembly 3'. The variable resistor with a light emitting element 100' is similar structurally and largely to the aforesaid variable resistor with a light emitting element 100 of FIG. 2. The major difference in between is that, in this embodiment 100', the slide assembly 3' applies two sliding bars 31' and 32' and two end blocks 33' and 34' to replace the two lateral sliding racks 31 and 32 and the two end blocks 33 and 34 of the aforesaid embodiment, respectively. In this embodiment, opposing ends of the two sliding bars 31' and 32' are mounted by the two end block 33' and 34' in the internal slide space defined by the housing 2' and the circuit board 1'. Also, the slidable member 35' has two parallel sliding slots (not shown in the figure) for allowing the two sliding bars 31' and 32' to penetrate therethrough, such that the slidable member 35' can displace back and forth along the two sliding bars 31' and 32' (extending in the longitudinal direction L) in the slide space. In addition, the two end blocks 33' and 34' include corresponding holes (not shown in the figure) to receive and engage the ends of the two sliding bars 31' and 32'.

In addition, in the aforesaid embodiment shown in FIG. 1 through FIG. 6, the fader set 36 includes two protrusive fader stem 361 and 362 spaced by the slit S. However, in this embodiment shown in FIG. 7 and FIG. 8, the fader set 36' simply includes a protrusive fader stem, and the light emitting element 37' is disposed in an accommodation room 361' located at a root portion of the protrusive fader stem of the slidable member 35'. Thereupon, as the light emitting element 37' projects a light beam upward to penetrate the protrusive fader stem, the light beam radiated from the accommodation room 361' would scatter to opposing lateral sides of the protrusive fader stem, and then penetrate through the sliding slot 21'.

In summary, by compared with the conventional variable resistors, the variable resistor with a light emitting element provided by the present invention mainly constructs the light-emitting element accommodating groove at the slidable member by closing to the sliding slot of the housing, and then the light emitting element is disposed in the light-emitting element accommodating groove. Further, the light-emitting element brush is introduced to electrically connect the light emitting element and the power circuit on the circuit board. Upon such an arrangement, as the user manipulates the fader set, the light emitting element can continuously project light beams toward the fader set. In addition, the fader set of the present invention can include a protrusive fader stem or two separated protrusive fader stems. In the case that the single protrusive fader stem is applied, the light beam emitted by the light emitting element would be blocked by the protrusive fader stem, and thus the radiation of the light beam would be leaked to the lateral sides of the protrusive fader stem. On the other hand, in the case that two protrusive fader stems with a middle slit are applied, the light beam emitted by the light emitting element would propagate through the slit to reach the top of the fader set. Further, by having a transparent fader cap to cap the two protrusive fader stems, while the light beam projects onto the fader cap, the light beam would light up the fader cap, so as to enhance the brightness over the fader set.

While the present invention has been particularly shown and described with reference to a preferred embodiment, it will be understood by those skilled in the art that various changes in form and detail may be without departing from the spirit and scope of the present invention.

What is claimed is:

1. A variable resistor with a light emitting element, comprising:

a circuit board, extending in a longitudinal direction, having a circuit arrangement surface, a resistive circuit and a power being arranged on the circuit arrangement surface;

a housing, fixed to the circuit board so as to form therebetween an internal slide space extending in the longitudinal direction, further having a sliding slot extending in the longitudinal direction, the sliding slot being communicative in space with the slide space; and a slide assembly, including:

a slidable member, movable in the longitudinal direction in the slide space, having a light-emitting element mounting surface and a brush mounting surface, the light-emitting element mounting surface facing the sliding slot, the brush mounting surface facing the circuit board, the slidable member further including a light-emitting element accommodating groove located at the light-emitting element mounting surface by closing to the sliding slot;

a fader set, fixed at the slidable member, penetrating the sliding slot;

a light emitting element, disposed in the light-emitting element accommodating groove, being to project a light beam toward the fader set;

a resistive circuit brush, disposed on the brush mounting surface, electrically connected with the resistive circuit; and two light-emitting element brushes, disposed on the brush mounting surface, being to electrically bridge the power circuit and the light emitting element; wherein, when the slidable member displaces in the longitudinal direction, the light emitting element continuously emits the light beam.

2. The variable resistor with a light emitting element of claim 1, wherein the slidable member further includes two terminal cavities located separately at the brush mounting surface, the two terminal cavities being communicative individually in space with the light-emitting element accommodating groove, two electrodes of the light emitting element being electrically connected with the two light-emitting element brushes via passing through the corresponding terminal cavities.

3. The variable resistor with a light emitting element of claim 2, wherein the two electrodes are plugged into the two terminal cavities, and each of the two light-emitting element brushes has a spring structure plugged in the corresponding terminal cavity and electrically connected with the corresponding electrode.

4. The variable resistor with a light emitting element of claim 3, wherein the spring structure has an interference structure to contact at the corresponding electrode.

5. The variable resistor with a light emitting element of claim 1, wherein the two light-emitting element brushes are riveted individually onto the slidable member.

6. The variable resistor with a light emitting element of claim 1, wherein the slide assembly further includes:

two lateral sliding racks, located fixedly and in parallel in the slide space, each of the two lateral sliding racks having a sliding groove extending in the longitudinal direction, two lateral sides of the slidable member being to slide along the corresponding sliding grooves of the respective lateral sliding racks, such that the slidable member is able to displace in the longitudinal direction in the slide space.

7. The variable resistor with a light emitting element of claim 6, wherein the slide assembly further includes:

two end blocks, disposed separately in the slide space to couple opposing ends of the two lateral sliding racks, each of the two end blocks being engaged the two lateral sliding racks at one side thereof and contacting the housing and the circuit board at other sides so as to locate fixedly the two lateral sliding racks in the slide space.

8. The variable resistor with a light emitting element of claim 1, wherein the slide assembly further includes:

two sliding bars, located fixedly and in parallel in the slide space, extending in the longitudinal direction, penetrating the slidable member so as to allow the slidable member to displace in the longitudinal direction in the slide space.

9. The variable resistor with a light emitting element of claim 8, wherein the slide assembly further includes:

two end blocks, disposed in the slide space at opposing ends of the two sliding bars, each of the two end blocks contacting the two sliding bars, the housing and the circuit board so as to locate the two sliding bars fixedly in the slide space.

10. The variable resistor with a light emitting element of claim 1, wherein the fader set includes:

a protrusive fader stem, located fixedly at the slidable member by protruding through the sliding slot; and a fader cap, capped to the protrusive fader stem;

wherein the light beam of the light emitting element is projected onto the protrusive fader stem.

11. The variable resistor with a light emitting element of claim 10, wherein the fader cap is transparent.

12. The variable resistor with a light emitting element of claim 1, wherein the fader set includes:

two protrusive fader stems, fixed at the slidable member by standing oppositely to two opposing sides of the light-emitting element accommodating groove and forming a slit in between, protruding to penetrate the sliding slot, the light beam emitted by the light emitting element being projected through the slit; and a fader cap, fixed at the two protrusive fader stems.

13. The variable resistor with a light emitting element of claim 12, wherein the fader cap is transparent.

* * * * *